United States Patent [19]

MacDonald

[11] 4,234,974

[45] Nov. 25, 1980

[54] PILLOW FOR COLOSTOMY

[76] Inventor: J. Bradford MacDonald, 511 Skyview Ave., Clearwater, Fla. 33516

[21] Appl. No.: 946,113

[22] Filed: Sep. 27, 1978

[51] Int. Cl.[3] ..... A47K 13/06

[52] U.S. Cl. ..... 4/235; 4/237; 4/DIG. 8

[58] Field of Search ..... 4/234, 237, 242, DIG. 8, 4/235, 1, 239; D23/71

[56] References Cited

U.S. PATENT DOCUMENTS

| | | | |
|---|---|---|---|
| D. 45,134 | 1/1914 | Waltensperger | D23/71 |
| 551,100 | 12/1895 | Scattergood | 4/235 |
| 1,189,767 | 7/1916 | Wilson | 4/234 |
| 1,990,869 | 2/1935 | Joyce | 4/235 |
| 3,653,076 | 4/1972 | Warnberg | 4/242 |
| 3,988,789 | 11/1976 | Blount | 4/236 |

*Primary Examiner*—Lenard A. Footland
*Attorney, Agent, or Firm*—Stein & Frijouf

[57] ABSTRACT

A seating device is disclosed for use with a water closet to aid a patient in recovering from a rectum operation such as a colostomy operation or the like. The device is suitable for use with a conventional water closet comprising a bowl having an upper terminating ring. The improvement comprises seat means being positionable above the terminating ring of the bowl for providing a seating surface. The seating surface includes a first support extending around the terminating ring of the bowl in a conventional manner. The invention comprises a second support portion extending across the bowl to substantially cover the back region of the bowl to support the area of incision of the patient. The device may comprise a resilient pillow or a plastic member for positioning on a conventional water closet seat. In the alternative, the device may be permanently mounted to replace the conventional water closet seat. The foregoing abstract is merely a resume of one general application, is not a complete discussion of all principles of operation or applications, and is not to be construed as a limitation on the scope of the claimed subject matter.

2 Claims, 11 Drawing Figures

PILLOW FOR COLOSTOMY

BACKGROUND OF THE INVENTION

1. Field of the Invention

This invention relates to water closets and more particularly to an improved seating device for water closets to aid a patient in recovering from a rectum operation.

2. Description of the Prior Art

Various types of seating devices have been devised to aid in the comfort and support of a person using a water closet. Other seating devices have been specifically designed to present a more favorable ornamental appearance. Still other seating devices have been devised for aiding the comfort of small children in the use of a water closet.

The prior art has also developed specific seating devices and accessories to conventional seating devices for aiding the recovery of a hemerrhoid patient and the like. Further, apparati have been devised for relieving constipation by providing accessory supporting members for the person using the water closet. An important area of concern is the comfort and recovery of patients after a rectum operation such as a colostomy operation or the like. The recovery from such an operation is extremely painful and is aggrevated by the present design of conventional water closet seats. The conventional water closet seats do not provide adequate support for the recovering patient from a colostomy operation. Accordingly, the patient undergoes severe pain while sitting on a conventional water closet seat as a result of inadequate support of the area of incision from the colostomy operation.

Accordingly, there is a need in the prior art for developing a seating device for use with a water closet specifically designed to aid in the comfort and recovery of a patient after a rectum or colostomy operation.

Therefore, it is an object of this invention to provide an apparatus which overcomes the aforementioned inadequacies of the prior art devices and provides an improvement which satisfies the present needs of the art and which is a significant contribution to the advancement of the water closet seating art.

Another object of this invention is to provide a device for use with a water closet to aid a patient in recovering from a rectum operation comprising a seat positionable relative to the horizontal ring of the bowl of the water closet which seat has a support portion covering the back region of the bowl for supporting the area of incision of the patient.

Another object of this invention is to provide a device for use with a water closet to aid a patient in recovering from a rectum operation wherein the seat may be pivotably and permanently mounted to the water closet or may be an independent seat which is positionable on a conventional water closet seat to cover the back region of the water closet bowl.

Another object of this invention is to provide a device for use with a water closet to aid a patient in recovering from a rectum operation wherein the seat may incorporate a resilient pillow or a molded plastic member positionable upon a conventional water closet seat.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment, in addition to the scope of the invention defined by the claims, taken in conjunction with the accompanying drawings.

SUMMARY OF THE INVENTION

The invention is defined by the appended claims to cover the disclosed embodiments shown in the attached drawings and the equivalent thereof as set forth in the detailed discussion. For the purpose of summarizing the invention, the invention may be incorporated into a device for use with a water closet to aid a patient recovering from a rectum operation. The water closet comprises a bowl having a terminating horizontal ring. The improvement comprises a seat means being positionable relative to the horizontal ring of the bowl for providing a substantially horizontal seating surface. The seat means has a support portion extending across the water closet bowl for supporting the area of incision of the patient.

More specifically, the seat means may be permanently and pivotably mounted to the water closet to replace a conventional water closet seat. In the alternative, the seat means may be an independent device positionable on a conventional water closet seat to cover the conventional water closet seat to aid the recovery of the patient. In either embodiment, the seat means may be a resilient pillow or a molded plastic member receivable on the conventional water closet seat. Optional positioning means such as a first and a second lip may engage opposed sides of the water closet seat to aid in the positioning of the seating means. The first and second lips include an inner and an outer lip for engaging the inner and the outer surfaces of the conventional water closet seat. In the alternative, attaching straps may be utilized for securing the seat means to the conventional water closet seat.

The seating surface has a first support portion extending about the terminating ring of the bowl to substantially cover the ring of the bowl. An important aspect of the invention comprises a second support portion extending across the bowl to substantially cover the back region of the bowl for supporting the area of incision of the patient. The support portion may cover substantially one-half of the back region of the bowl.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Figure 1:
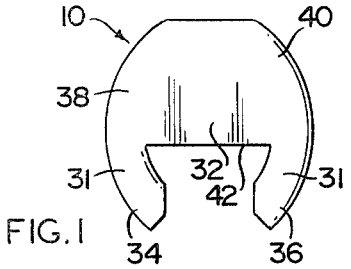
FIG. 1 is an a plan of a first embodiment of a device for use on a water closet.

Similar reference characters refer to similar parts throughout the several views of the drawings. For a more clearer understanding of the invention, the following number identifications taken in connection with the detailed description and the drawings set forth the preferred mode or practice of the invention:

| | | | |
|---|---|---|---|
| 10 | device | 34 | projections |
| 10A | device | 36 | projections |
| 10B | device | 38 | outer region |
| 12 | water closet | 40 | outer region |
| 14 | bowl | 42 | terminating edge |
| 16 | ring | 44 | padding |
| 18 | floor | 46 | covering |
| 20 | conventional seat | 48 | stud |
| 22 | pivot | 50 | nut |
| 22A | pivot | 51 | first positioning means |
| 24 | seat lid | 51A | outer lip |
| 31 | first support portion | 51B | inner lip |
| 31A | first support portion | 52 | second positioning means |
| 31B | first support portion | 52A | outer lip |
| 32 | second support portion | 52B | inner lip |
| 32A | second support portion | | |
| 32B | second support portion | | |

DETAILED DESCRIPTION

Figure 2:
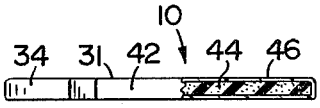
FIG. 2 is a front view partially in section of the device shown in FIG. 1.
Figure 3:
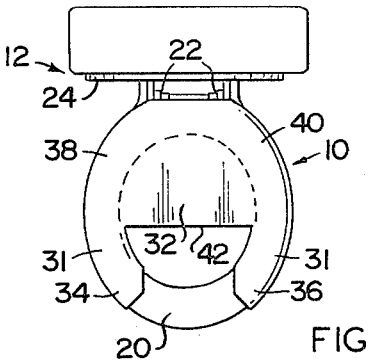
FIG. 3 is a plan view of the device in FIGS. 1–2 positioned on a conventional water closet.
Figure 4:
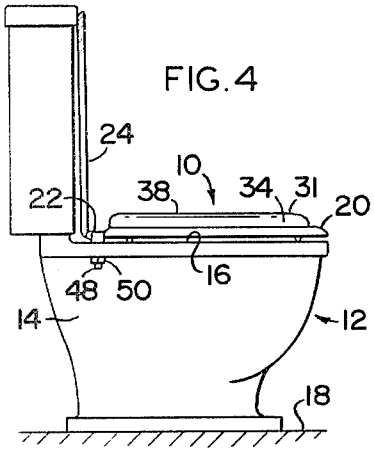
FIG. 4 is a side elevational view of the device positioned on the water closet seat.

FIGS. 1 and 2 illustrate plan and front elevational views of a device 10 for use with a water closet 12 shown in FIGS. 3 and 4 for aiding a patient in recovery from a rectum operation such as a colostomy or the like. The water closet 12 comprises a bowl 14 terminating in a horizontal ring 16 which ring is generally in the shape of an ellipse. The water closet 12 is secured to the floor 18 in a conventional manner making the terminating ring 16 substantially horizontal. A conventional water closet seat 20 shown as an oval seat is mounted by a pivot 22 to the water closet 12. A seat lid 24 is similarly pivotably mounted by pivot 22 to the water closet 12 in a conventional manner.

The device 10 in the first embodiment comprises seat means being positionable upon the conventional seat 20 for providing a substantially horizontal seating surface. The seating surface includes a first support portion 31 and a second support portion 32. The first support portion 31 includes projections 34 and 36 and the outer regions 38 and 40 to substantially cover the upper surface of the terminating ring 16 of the water closet 12. The second support portion 32 is defined in part by a terminating edge 42 which extends across the bowl 14 to substantially cover the back region of the bowl 14 to support the area of incision of the patient. When the patient sits upon the device 10, the area of incision is supported by the second support portion 32 thereby reducing the stress caused to the area of incision of the patient. It has been found that such support substantially aids the comfort and recovery of a colostomy patient.

The embodiment shown in FIGS. 1–4 is the preferred form of the invention. In this embodiment the device 10 is a resilient pillow having an internal resilient foam inner padding 44 covered by an outer covering or skin 46 which is preferably made of nylon or vinyl material. Specimens of this invention have been made of two inch sponge foam or similar material. The device 10 may be positioned on the water closet 12 with straps, ties or snaps (not shown) to maintain the position of the device 10A on the water closet 12.

Figure 5:
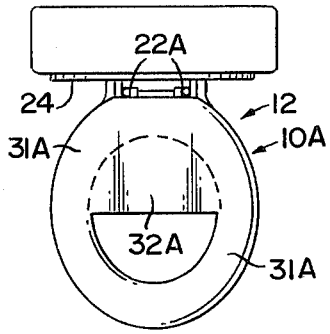
FIG. 5 is a plan view of a second embodiment of the invention showing the device permanently mounted on a water closet.
Figure 6:
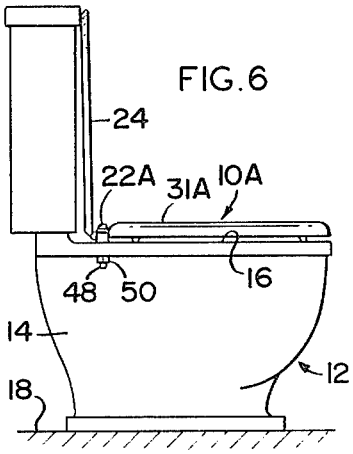
FIG. 6 is a side elevational view of the water closet shown in FIG. 5.

FIGS. 5 and 6 illustrate a second embodiment of the invention showing a device 10A positioned on the water closet 12 in a manner similar to the device 10 shown in FIGS. 1–4. In this embodiment, the device 10A is permanently mounted to the water closet 12 by pivot 22A. The device 10A includes a first support portion 31A and a second support portion 32A in a manner similar to that shown in FIGS. 1–4. The device 10A replaces the conventional water closet seat 20 shown in FIG. 4. The device 10A may be readily mounted to the water closet 12 by inserting a stud 48 connected to pivot 22A through apertures in the water closet 12 and securing the device 10A with a nut 50.

Figure 7:
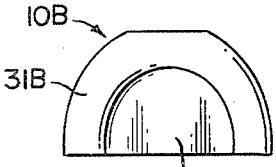
FIG. 7 is a plan view of a third embodiment of the invention illustrating a device for use with a conventional water closet seat.
Figure 8:
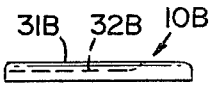
FIG. 8 is a side elevational view of the device shown in FIG. 7.
Figure 9:
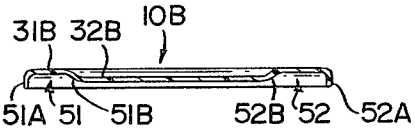
FIG. 9 is a front elevational view of the device shown in FIG. 7.
Figure 10:
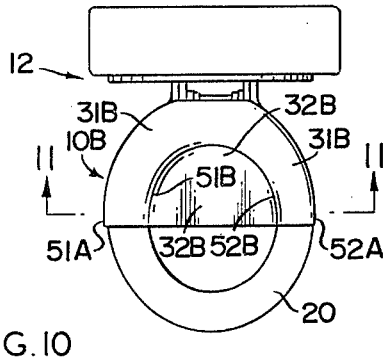
FIG. 10 is a plan view of the device shown in FIGS. 7–9 positioned on a conventional water closet seat.
Figure 11:
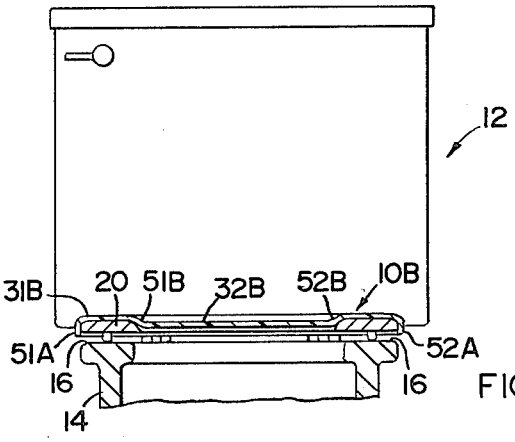
FIG. 11 is a sectional view along line 11—11 of the device shown in FIG. 10.

FIGS. 7–8 illustrate a third embodiment of the invention comprising a device 10B which is positionable upon a conventional water closet seat 20 shown in FIGS. 10 and 11. The device 10B is a single formed material such as plastic or the like having a first support portion 31B and a second support portion 32B. This device 10B comprises means shown as first and second lips for engaging the inner and outer surfaces of the conventional water closet seat 20. A first lip 51 comprises an outer lip 51A and an inner lip 51B for respectively engaging the outer and inner portions of the conventional seat 20. In a similar manner, the second lip 52 comprises an outer lip 52A and an inner lip 52B for respectively engaging the outer and inner portions of the conventional seat 20 as shown in FIG. 11. Accordingly, the first and second inner and outer lips 51A–52A and 51B–52B position the device 10B on the conventional seat 20. The device 10B may optionally include a resilient covering or the like.

Immediately following a colostomy operation, the internal organs of a patient must be irrigated to initiate the removal of body waste. This process is generally conducted on a conventional water closet seat. In severe colostomy incisions, a substantial amount of pain is encountered while sitting on a conventional water closet seat. Accordingly, the present invention eliminates this severe pain by providing support to the area of incision during the irrigation process.

The foregoing has described a device for use with a water closet to aid a patient recovering from a rectum operation such as a colostomy or the like. The embodiments have been shown which may be quickly and removably mounted on a conventional water closet seat or in the alternative be permanently mounted to the water closet. The specification has described various materials and other desirable features of the invention in the various embodiments set forth herein. It should be appreciated that the desirable characteristics of each of the three embodiments may be interchanged or modified while still accomplishing the desired result. A substantial aspect of the invention is the support extending across the water closet bowl for supporting the area of incision of the patient. In the preferred form, the support portion covers the back region of the bowl to provide firm and complete support for the recovering patient.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

What is claimed is:

1. A device for use with a water closet to aid a patient in recovering from a rectum operation, the water closet comprising a bowl having a conventional water closet seat, comprising in combination:

seat means being positionable upon the conventional water closet seat for providing a substantially horizontal seating surface;

said seat means having a continuous substantially semi-circular supporting position;

the periphery of the curved area of the semi-circular supporting portion established for resting on the rear portion of the water closet seat enabling the straight portion to extend across the substantial center of the water closet bowl;

said seat means including plural projections extending from said substantially straight portion for at least partially covering the front portion of the water closet seat; and said seat means having a resilient interior covered by a protective covering for providing a resilient support surface to completely cover substantially the rear half of the water closet bowl for completely supporting the area of incision of the patient.

2. A device as set forth in claim 1, wherein said seat means comprises a resilient pillow having a foam interior and a liquid-impervious covering; and said foam interior being sufficiently rigid to provide support to the area of incision of the patient while concomittently being yielding to aid the comfort of the patient.

* * * * *

UNITED STATES PATENT AND TRADEMARK OFFICE

CERTIFICATE OF CORRECTION

PATENT NO. : 4,234,974

DATED : November 25, 1980

INVENTOR(S) : J. Bradford Macdonald

It is certified that error appears in the above—identified patent and that said Letters Patent is hereby corrected as shown below:

Column 6, line 9, delete "position" and insert -- portion --.

Signed and Sealed this

*Seventh* Day of *April 1981*

[SEAL]

*Attest:*

RENE D. TEGTMEYER

*Attesting Officer*

*Acting Commissioner of Patents and Trademarks*